United States Patent [19]

MacKay, Jr.

[11] Patent Number: 4,924,634

[45] **Date of Patent: * May 15, 1990**

[54] FINISHING ARTICLE HAVING AN INTEGRAL MOUNTING HUB AND IMPROVED BASE

[76] Inventor: Joseph H. MacKay, Jr., 17551 Cabela Dr., San Diego, Calif. 92127

[ * ] Notice: The portion of the term of this patent subsequent to Jul. 5, 2005 has been disclaimed.

[21] Appl. No.: 212,448

[22] Filed: Jun. 28, 1988

Related U.S. Application Data

[63] Continuation-in-part of Ser. No. 5,812, Jan. 21, 1987, Pat. No. 4,760,670, which is a continuation-in-part of Ser. No. 847,793, Apr. 3, 1986, Pat. No. 4,694,615.

[51] Int. Cl.[5] ..... B24B 45/00

[52] U.S. Cl. ..... 51/168; 51/209 R; 51/378; 15/98; 15/230.19

[58] Field of Search ..... 51/168, 209 R, 358, 51/376, 377, 378, 389, 391, 392, 393; 15/230.18, 230.19, 98

[56] References Cited

U.S. PATENT DOCUMENTS

| | | | |
|---|---|---|---|
| 533,958 | 2/1895 | King | 51/168 X |
| 3,136,100 | 6/1964 | Robertson, Jr. | 51/209 R |
| 3,596,415 | 8/1971 | Donahue, Jr. | 51/378 |
| 3,912,411 | 10/1975 | Moffat | 51/168 X |
| 4,322,920 | 4/1982 | Wells | 51/376 X |
| 4,439,953 | 4/1984 | Block et al. | 51/389 |
| 4,449,329 | 5/1984 | Sauerwein et al. | 51/168 |
| 4,754,577 | 7/1988 | MacKay, Jr. | 51/168 |
| 4,754,578 | 7/1988 | MacKay, Jr. | 51/168 |
| 4,760,670 | 8/1988 | MacKay, Jr. | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable finishing article for mounting on a rotatable threaded spindle which may be used with a power tool. The finishing article contains a retaining nut on one side and a backing flange on the other non-removably secured together on the finishing article wihtout the aid of adhesives in such a manner that the finishing article is placed in compression when it is operably secured upon the spindle of the power tool under operational loads. The nut and flange are secured together by upsetting one end of the nut causing it to protrude outwardly over the outer surface of the flange. A generally inverted cup shaped member is carried by the spindle for engaging the outer surface of the backing flange or the finishing article during operation of the finishing article.

18 Claims, 3 Drawing Sheets

88
80
82
86
84
90
92
94
14
72
76
60
62
66
3
35
28
34
35
38
32
30
40
39
3
18
24
26

56
52
44
46
48

FIG. 9
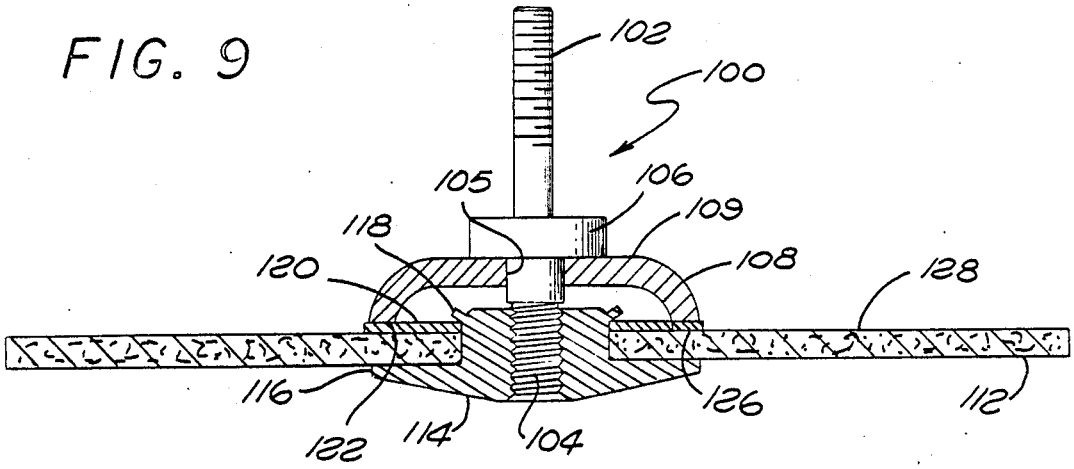
FIG. 10
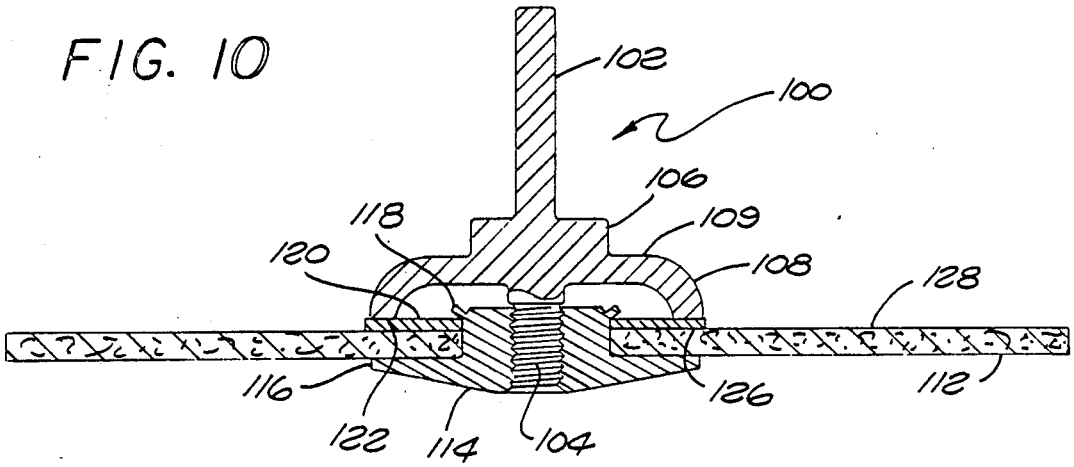
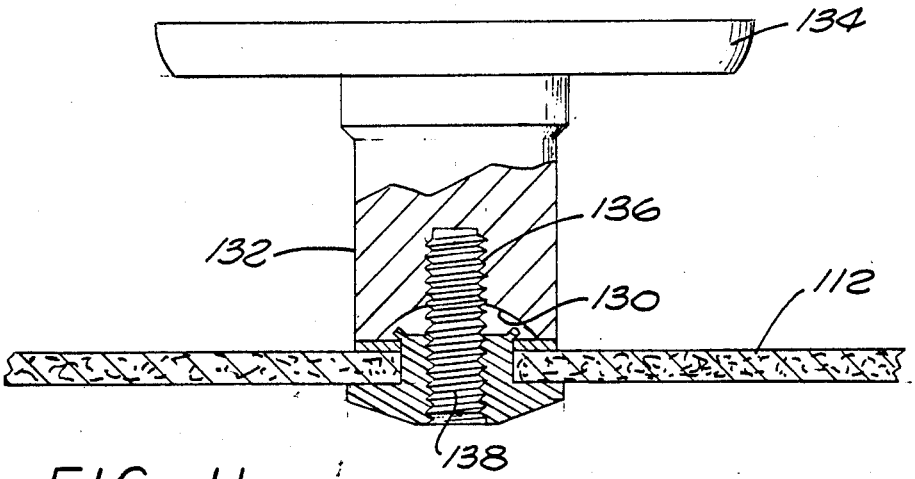
FIG. 11

FINISHING ARTICLE HAVING AN INTEGRAL MOUNTING HUB AND IMPROVED BASE

RELATED APPLICATION

This application is a continuation-in-part of U.S. Patent Application Ser. No. 005,812 filed Jan. 21, 1987 for DISPOSABLE DEPRESSED CENTER GRINDING WHEEL HAVING AN INTEGRAL MOUNTING HUB , now U.S. Pat. No. 4,760,670, which is a continuation-in-part of U.S. Patent Application Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to finishing articles and more particularly to such articles with a mounting hub permanently affixed thereto with the combination adapted for attachment to an appropriate portable power tool.

BACKGROUND OF THE INVENTION

The use of rotatably driven finishing articles and particularly grinding wheels is widespread and familiar in our industrial society. One of the more serious problems encountered in the use of such devices resides in the provision of effective means for preventing undesired or accidental disassociation of the finishing article or grinding wheel from the shaft, spindle or other rotatable drive means on which it is mounted. This problem is particularly acute when the connection between the finishing article or grinding wheel and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly of ports has been used for large grinding wheels as well as small cut-off wheels. Such an assembly, however, typically requires appropriate tools such as wrenches or the like to remove the grinding wheel from the drive shaft. Such a device is shown in U.S. Pat. Nos. 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,601,661; 791,791; 872,932; 2,567,782; 3,136,100, 3,210,892 and 3,621,621.

The devices utilized in the prior art for providing the disposable grinding wheel assembly including the permanently affixed mounting hub generally provide the service intended. There are certain inherent disadvantages found with regard to the various devices. Such disadvantages are that in manufacturing the utilization of an adhesive adds additional materials and labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulky, take up space and add substantial weight and additional cost to the completed product.

SUMMARY OF THE INVENTION

A finishing article having a drive member nonremovably affixed thereto for mounting on a spindle for rotation by a power tool. The drive member includes a backing member on one side of the finishing article and a retaining nut positioned on the opposite side of the finishing article from the backing member. The nut extends through an opening in the finishing article and has a radial flange at one end thereof seated against the face of the article and protrusion means extending from the other end thereof for non-removably securing the retaining nut and the backing member together on the finishing article without the use of adhesives. A base member or adapter carried by the spindle engages the outer surface of the backing member to apply pressure to the member during operation of the finishing article. Alternatively the adapter may directly engage the finishing article. More particularly, the base member or adapter is an integral inverted cup shaped member which may include a plastic surface for engaging one of the backing member or the power tool.

DETAILED DESCRIPTION

Figure 1:
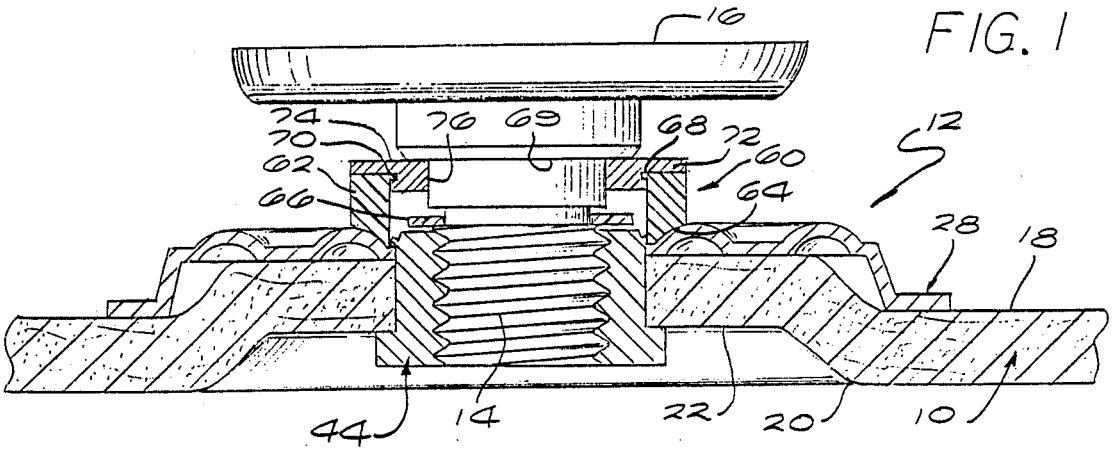
FIG. 1 is a cross sectional view of a disposable grinding wheel assembly constructed in accordance with the principles of the present invention and mounted in operable position on the spindle of a power tool.

The present invention is useful with a multiplicity of finishing articles such as buffs, wire brushes, grinding wheels, cut-off wheels and the like. However, for purposes of clarity and ease of illustration the invention will be primarily described in conjunction with a depressed center grinding wheel. By reference now more specifically to FIGS. 1 through 5, there is illustrated a disposable depressed center grinding wheel having a drive member assembly constructed in accordance with the principles of the present invention. As is therein shown a depressed center grinding wheel 10 has a disposable drive member assembly 12 permanently affixed thereto so that the grinding wheel may be attached to the spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force is applied to the grinding wheel during utilization thereof, the greater the operational compression becomes. As a result of placing the grinding wheel in such compression the grinding wheel is maintained upon the spindle and cannot fly off and at the same time, through the compression or clamping force as applied, the drive wheel 10 cannot rotate relative to the driving member or hub 12. However, as a result of the construction of the driving member assembly, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized.

A backing member or flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. A pair of reinforcing ribs 32 and 34 are formed in the backing flange 28 concentrically with the opening 30. A plurality of radial reinforcing ribs 35 are equiangularly disposed and interconnect the concentric ribs 32 and 34. The combination of the concentric and radial reinforcing ribs have been found to provide surprising stiffness to the backing flange 28. Such stiffness allows extreme loads to be applied to the grinding wheel during use. The backing flange 28 is preferably stamped from sheet metal but of course could be constructed from other materials such as hard molded plastic or die cast metal should such be desired.

Figure 3:
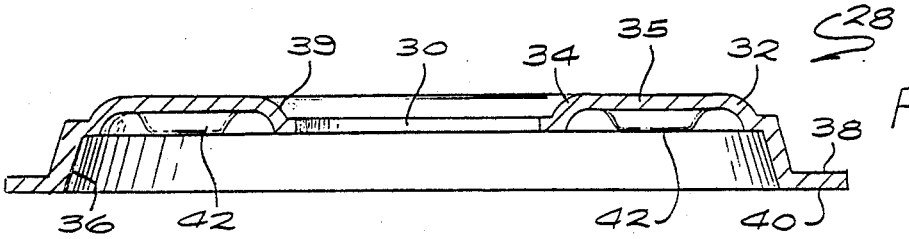
FIG. 3 is a cross sectional view of a backing member constructed in accordance with one embodiment of the present invention and about the line 3—3 of FIG. 2.
Figure 4:
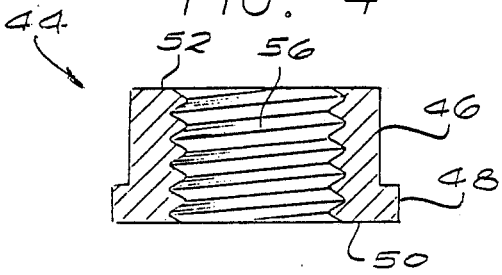
FIG. 4 is a cross section view of a retaining nut constructed in accordance with the principles of the present invention.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes a pair of lands 40 and 42, the land 42 being discontinuous. The land 40 is formed about the outer peripheral portion of the backing flange 28. The land 42 is displaced inwardly toward the opening 30 and away from the land 40. The land 40 engages the back surface 18 of the abrasive finishing wheel away from the depressed center while the land 42 may engage the back surface of the abrasive finishing wheel 10 opposed the depressed center 22 thereof depending upon variations in wheel dimensions and manufacturing tolerances in the wheel and flanges. Preferably during construction as hereinafter described, the land 42 is pressed against the back surface of the wheel and retained there.

As can be seen, particularly in FIG. 3, the ribs 32 and 34 formed in the outer surface 38 of the backing flange 22 are continuous. The continuous rib 32 is disposed between the lands 40 and 42 and over the transitional area between the depressed center and the remainder of the grinding wheel 10 while the continuous rib 34 is disposed intermediate the opening 30 and the land 42.

A retainer nut 44 includes a body portion 46 which is hollow and has a radially outwardly extending flange 48 at a first end 50 thereof. At the opposite or second end 52 of the body and slightly displaced therefrom there is provided a recess such as a continuous groove 54 which is formed at the time of assembly after the body 46 is inserted through the openings in the wheel 10 and backing flange 28. The internal surface of the body 46 has threads 56 formed therealong for attachment to the threaded spindle 14 of the power tool. The nut 44 is inserted through the aperture 26 in the grinding wheel and the aperture 30 in the flange 28 from the front 20 toward the rear 18 of the grinding wheel 10. The end 52 of the nut 44 extends through the opening 30 in the flange 28 for a distance not exceeding the top of the rib 34.

Figure 5:
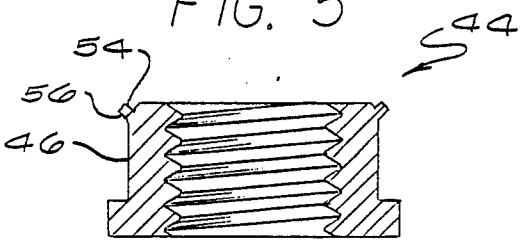
FIG. 5 is a cross sectional view of the retaining nut of FIG. 5 after being upset.

Once the nut 44 has been inserted through the openings in the wheel 10 and the flange 28, the flange is pressed firmly against the back of the grinding wheel and the end 52 of the nut 44 is upset, such as by a staking operation, to provide the continuous groove 54 as shown specifically in FIG. 5. The upsetting operation causes a protrusion 56 to extend outwardly from the body 46 in such a manner as to engage the flange 28 about the outer surface 38 thereof adjacent the opening 30 therethrough and is the only means used for securing the flange 28 and the nut 44 on the wheel 10. The protrusion 56 is illustrated as being continuous as is the groove 54, although it should be understood that it may be intermittent should such be desired. It should become apparent to those skilled in the art that the flange 28 and the nut 44 are mechanically secured together on the wheel 10 between the flange 48 and the protrusion 56 without the use of adhesives.

The nut 44 is preferably constructed from an aluminum extrusion which is then machined to provide the flange 38 and the threads 46. Alternatively the nut may be formed from aluminum or steel bar stock, or a metal die casting.

To provide proper operation of the throw-away grinding wheel as described, there is provided a base assembly or adapter 60 which includes an inverted cup shaped member 62 having a first surface 64 which is adapted for engaging a portion of the flange 28 such for example as the portion 39 of the outer surface of the rib 34 on the flange 28 adjacent the opening 30. The cup shaped member 62 is held loosely in place on the spindle 14 by a retaining member 66 which, as shown in FIG. 1 in the preferred embodiment, may be a nylon washer which is threadable onto the threaded spindle 14. The nylon washer 66 will then loosely retain the cup shaped member 62 upon the spindle 14 at all times whether or not a grinding wheel is maintained in place.

The cup shaped member 62 includes a cylindrical hollow body having an open end defining the surface 64. In this embodiment, where the flange 28 includes the rib 34, the surface 64 has a radius of curvature which substantially matches the radius of curvature of the rib 34 and therefor easily seats thereon. The opposite end of the cylindrical body includes an inwardly directed rib or protrusion 68. The protrusion 68 is received within a groove 70 formed on an annular metal cap 72. The cap 72 snaps into place on the body 66 and is freely rotatable with respect thereto. The upper surface 74 of the cap 72 engages the power tool 16 when a grinding wheel is in operative position thereon. The cap 72 also defines an opening 76 therein through which the spindle 14 extends. As will be apparent to those skilled in the art, the cylindrical body 66 may have any length desired to accommodate power tools of varying dimensional configurations.

Through utilization of the two part integral cup shaped member 62 the grinding wheel 10 may be easily threaded onto the spindle 14. Upon commencing use, there may be some relative rotation between the cap 74 and the body 66 which would increase the compression between the flange 28 and the nut 44 to hold the wheel 1? securely. The two piece cup shaped member also performs another important function. The second function is to assist in removal of the wheel 10 from the power tool 16 after the wheel 10 is spent. Since tremendous forces are generated during a grinding operation particularly using large grinding wheels, metal-to-metal surfaces, particularly of similar types, tend to bind or gall thereby necessitating the application of relatively large forces to remove the spent wheel. The self lubricating dissimilar surfaces between the cap 72 and cylinder body 66 provide an almost immediate release upon the application of minimal release pressure to the wheel 10.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 64 on the body 66 engages the surface 39 on the rib 34 on the flange 28. The flange is forced in a downward direction by such engagement. At the same time the interengagement between the threads 14 and 56 of the spindle and nut, respectively, urge the nut upward toward the flange 28 to cause the grinding wheel to be placed in compression between the backing flange 28 and the radial flange 48 an the nut 44. An examination of the drawings, particularly FIG. 1, will disclose that when the grinding wheel is in operation forces are transmitted downwardly from the power tool 16, the cap 72, the body 66, the surface 64 and the land 34 of the flange 28. At the same time, forces are being applied upwardly through the flange 48 on the nut 44. These forces are generated through the threaded engagement between the spindle 14 and the interior 56 of the nut 44 through application of torque to the rotating wheel when it is placed into engagement with a workpiece. Those skilled in the art will recognize that as the grinding wheel 10 is used by being placed against a workpiece additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. It should also be noted that the inner surface of the cup shaped member 62 provides a space or chamber 71 above the top 52 of the nut 44. This chamber 71 provides room for the nut to move upwardly during operation in a manner unrestricted by the power tool or adapter assembly.

Figures 2, 6, 7:
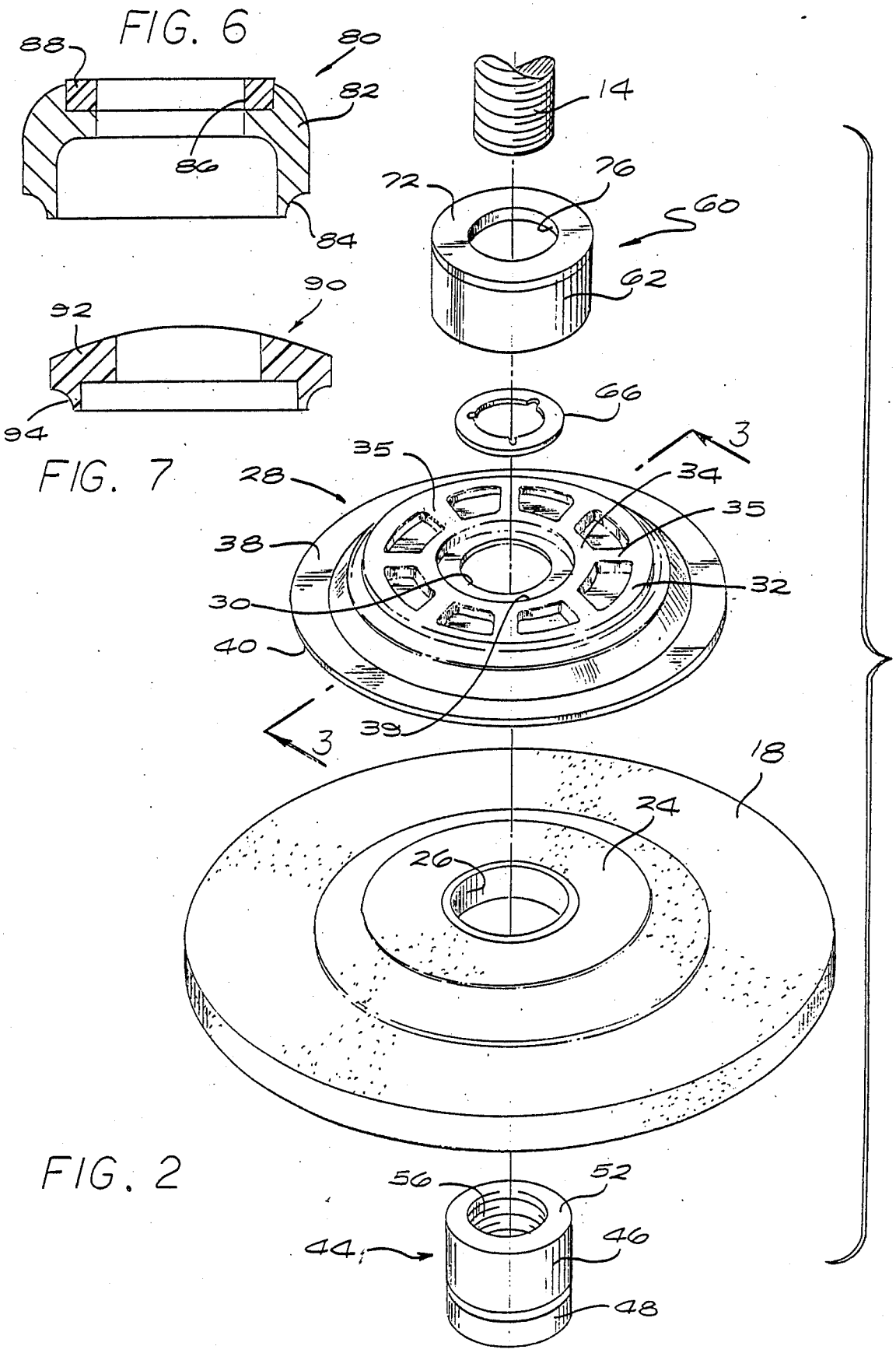
FIG. 2 is an exploded view of the structure as illustrated in FIG. 1.
FIG. 6 is a cross sectional view of an alternative embodiment of an adapter.
FIG. 7 is a cross sectional view of another alternative embodiment of an adapter.

Referring now more particularly to FIG. 6 there is shown in cross section an alternative embodiment of a base assembly or adapter member in accordance with the present invention. As is therein shown, an inverted cup shaped member 80 includes a metal body 82 defining a curved surface 84 which conforms in radius of curvature to the rib 34. A recess 86 is provided for receiving a plastic washer insert 88 which is held in place by force fitting into the recess 86. The structure 80 performs the same function as above described except that the entire adapter 80 rotates upon engagement with the grinding wheel with the washer 88 allowing easy release.

FIG. 7 discloses another alternative embodiment of a base member or adapter in accordance with the present invention. As is therein shown an inverted cup shaped member 90 includes a body 92 of a molded self lubricating plastic defining a surface 94 having a radius of curvature conforming to that of the rib 34. This adapter functions in the same manner as above described.

In numerous other applications utilizing finishing articles of various types, smaller and less powerful power tools may be utilized. In many applications, the base assembly or adapter will include a removable spindle having a shank adapted for insertion into a collet or an internally threaded opening in a spindle of a hand held power tool for receiving a threaded shank. For example, in the utilization of wire brushes, buffs or cut-off wheels such a structure is preferred. Now by reference to FIG. 8, there is illustrated in cross section a cut-off wheel which employs the principles of the present invention and includes yet another alternative embodiment of a base assembly or adapter for use therewith.

Figure 8:
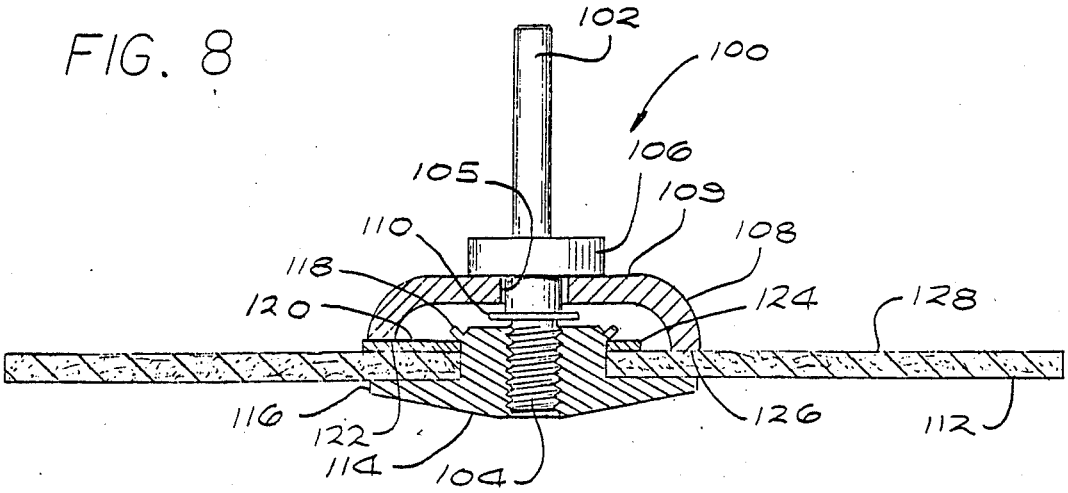
FIG. 8 is a cross sectional view of a cut-off abrasive grinding wheel constructed in accordance with the principles of the present invention mounted in operable position on a spindle for insertion into the collet of a power tool.

As is shown in FIG. 8, the adapter 100 includes a shank 102 for insertion into and gripping by the collet of a hand held power tool (not shown). The adapter 100 also includes a lower threaded portion 104. The shank 102 and the threaded portion 104 are separated by a collar 106. A support flange in the form of an inverted cup shaped member 108 is held in position loosely upon the threaded portion 104 beneath the collar 106. When the adapter 100 is assembled, the threaded shank 104 is inserted through the opening 105 in the support flange 108 until the collar !06 rests against the rear surface 109 thereof. A staking tool is then inserted over the threads 104 and the shaft is upset to provide a radial protrusion as shown at 110, which may be continuous or discontinuous, thereby to loosely retain the supporting flange 108 on the threaded shank 104. The support flange 108 utilized in this instance is preferably constructed of metal as is illustrated and may be stamped, milled or die cast as desired.

A cut-off wheel 112 includes a retaining nut 114 having a flange 116 extending radially outwardly from the nut 114. The opposite end of the nut includes an outwardly directed lip 118 which secures a backing member 120 in place on the opposite side of the cut-off wheel 112 from the flange 116.

It has been found that with a cut-off wheel 112, the stiffness provided by the backing flange as above described is not required. With the structure similar to that shown in FIG. 8, the backing member 120 functions primarily to hold the nut 114 in place on the cut-off wheel 112. It has in fact been found that the backing member 120 may have a diameter which is less than the inner diameter of the supporting flange 108. With such a modification the supporting flange 108 and the nut flange 116 will still provide the appropriate function of placing the cut-off wheel 112 in compression as above described.

It will be recognized from the preceding description that when the cut-off wheel 112 is placed into operation, forces are generated directed downwardly by the supporting flange 108 against the wheel 112 while the nut 114 through the threaded engagement with the threaded portion 104 of the adapter 100 is urged upwardly as viewed in FIG. 8. A chamber 120 is provided in the supporting flange 108 to permit movement upwardly of the nut 114 without interference by the supporting flange. As these oppositely directed forces are applied, the cut-off wheel 112 is securely clamped in position on the adapter 100 as above described.

When the wheel 112 is spent through appropriate usage, it may be easily removed from the spindle 102 by simply applying appropriate hand force thereto. Even though metal to metal contact is utilized in the preferred embodiment of the structure shown in FIG. 8, the contact areas are small enough that easy release is accomplished. If desired, however, a plastic insert may be utilized in the supporting flange 108 or alternatively, the backing member 120 may be made of plastic if such is desired. It will be noted that the contact area 122 of the support flange 108 is flat (non-curved) as compared to the adapters above described. Such occurs simply because the surface of the backing member 120 or the wheel 112 is planar and therefore, for the best operation should be contacted with a flat contact surface.

As above described, the backing member 120 may have a diameter which is less than the diameter of the supporting flange 108. Such is illustrated at 124 by showing the backing member 120 stopped short of the inner diameter of the adapter 108. In such an instance, the contact surface 126 of the supporting flange 108 would engage the back surface 128 of the cut-off wheel 112. Although for purposes of illustration and proper description of the invention, the diameter has been shown as differential in FIG. 8, the diameter of the backing member 120 would be uniform in any particular application.

By reference to FIG. 9 therein shown an alternative embodiment of a cut-off wheel constructed in accordance with the present invention. The same reference numerals used in FIG. 8 are used in FIG. 9 with respect to similar components. As therein shown, the support flange 108 is provided with an opening 105 which is of the same diameter as the shank 104. In assembly the support flange 108 is press fitted onto the shank 104 and thereby provides an interference fit therebetween. This structure rigidly secures the support flange 108 and shank 104 together as opposed to the loose retention of FIG. 8. As is shown in FIG. 9, the shank 102 is threaded fcr reception by an internally threaded opening in a spindle of a power tool.

As is clearly shown in FIG. 10, the adapter may be constructed of a single unitary member as by casting or milling from bar stock. Again, or in FIG. 9, the adapter would be rigid in character.

If desired, as shown in FIG. 11, the inverted cup shaped member may be formed as shown at 130 in the spindle 132 of the power tool 134. An internally threaded opening 136 is provided in the spindle 132 and a threaded stud 138 is inserted into the threaded opening 136. Thereafter a cut-off wheel 112 with a nut 114 and backing member 120 is threadably secured upon the stud 138. As can be seen, the cup shaped member 130 in the power tool spindle functions precisely the same as the support flange 108 of FIGS. 8 through 10.

It will be recognized by those skilled in the art that the grinding wheel assemblies as illustrated in FIGS. 1 through 11 and as above described require no adhesive for construction and may be simply and easily assembled, are relatively light in weight as compared to the prior art devices utilizing the cast hubs and provides a secure attachment of the grinding wheel to the power tool and through the utilization of the increased compression precludes relative rotation of the grinding wheel with regard to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

There has thus been disclosed a disposable grinding wheel-driving member assembly which securely holds the grinding wheel during operation, which is light in weight, vibration-free, and less expensive than prior art throw-away grinding wheels while meeting all safety standards currently known and in existence.

What is claimed is:

1. A finishing article having a disposable drive member non-removably affixed thereto for mounting on a threaded rotatable spindle for use with a power tool comprising:

a finishing article having a face and a back and having a first centrally disposed aperture therethrough;

a backing member having an inner and outer surface and a diameter smaller than the diameter of said finishing article and defining a second centrally disposed aperture therethrough, said backing member inner surface seated on said back of said finishing article with said first and second apertures aligned;

a retaining nut having a hollow internally threaded body having first and second ends and a first radially outwardly extending flange extending from said first end of said body, said body extending through said first and second apertures of said finishing article with said radial flange seated against said face;

means protruding outwardly from said second end of said body to non-removably secure said retaining nut and said backing member together on said finishing article without the use of adhesives and allowing relative axial movement between said retaining nub and said backing member; and adapter means for applying force to said finishing article when said finishing article is threadably affixed to and seated on said spindle, whereby relative axial movement between said retaining nut and adapter means toward each other is permitted to thereby increasingly compress said finishing article as operative loads are applied to said finishing article during use on said power tool, said adapter means including an inverted generally cup shaped member.

2. A finishing article as defined in claim 1 wherein said adapter means includes means for loosely retaining said cup shaped member on said spindle in the absence of a finishing article.

3. A finishing article as defined in claim 2 wherein said backing member outer surface and said adapter each includes mutually abutting surfaces to apply force to said backing member and compress said article between said backing member and said flange on said nut.

4. A finishing article as defined in claim 3 wherein said backing member outer surface defines a circular reinforcing rib disposed adjacent said second aperture and having a predetermined radius of curvature and said adapter includes a surface having a radius of curvature conforming substantially to the radius of curvature of said reinforcing rib.

5. A finishing article as defined in claim 4 wherein said backing member includes a second circular reinforcing rib displaced outwardly from said first rib and a plurality of radial reinforcing ribs interconnecting said circular ribs.

6. A finishing article as defined in claim 5 wherein said cup shaped member includes a plastic body and metallic cap, said cap being retained on said body to provide an integral member having relative rotation between said body and cap 7. A finishing article as defined in claim 5 wherein said cup shaped member includes a metallic body and a molded plastic insert received within said body at one end thereof.

8. A finishing article as defined in claim 5 wherein said cup shaped member is a molded plastic body.

9. A finishing article as defined in claim 1 wherein said backing member is a washer shaped member and wherein said backing member and said adapter each includes mutually abutting surfaces to apply force to said backing member and compress said article between said backing member and said flange on said nut.

10. A finishing article as defined in claim 9 wherein said adapter and said backing member are constructed of metal.

11. A finishing article as defined in claim 9 wherein said adapter is metal and said backing member is plastic.

12. A finishing article as defined in claim 9 which further includes means for loosely retaining said cup shaped member on said spindle.

13. A finishing article as defined in claim 12 wherein said means for loosely retaining said cup shaped member includes a radial protrusion on said spindle.

14. A finishing article as defined in claim 9 wherein said cup shaped member is secured on said spindle by an interference fit therebetween.

15. A finishing article as defined in claim 1 wherein said cup shaped adapter includes a lip having a predetermined diameter and said backing member has a diameter less than said predetermined diameter of said lip.

16. A finishing article having a disposable drive member non-removably affixed thereto for use with a power tool comprising:

a finishing article having a face and a back and having a first centrally disposed aperture therethrough;

a backing member having an inner and outer surface and a diameter smaller than the diameter of said finishing article and defining a second centrally disposed aperture therethrough, said backing member inner surface seated on said back of said finishing article with said first and second apertures aligned;

a retaining nut having a hollow internally threaded body having first and second ends and a first radially outwardly extending flange extending from said first end of said body, said body extending through said first and second apertures of said finishing article with said radial flange seated against said face;

means protruding outwardly from said second end of said body to non-removably secure said retaining nut and said backing member together on said finishing article without the use of adhesives and allowing relative axial movement between said retaining nub and said backing member; and adapter means for applying force to said finishing article when said finishing article is attached to said power tool whereby relative axial movement between said retaining nut and adapter means toward each other is permitted to thereby increasingly compress said finishing article as operative loads are applied to said finishing article during use on said power tool, said adapter means including a threaded spindle and an inverted generally cup shaped member carried on said spindle, said spindle being receivable by said power tool.

17. A finishing article as defined in claim 16, wherein said spindle and cup shaped member are formed as a unitary member.

18. A finishing article having a disposable drive member non-removably affixed thereto for use with a power tool comprising:

a finishing article having a face and a back and having a first centrally disposed aperture therethrough;

a backing member having an inner and outer surface and a diameter smaller than the diameter of said finishing article and defining a second centrally disposed aperture therethrough, said backing member inner surface sated on said back of said finishing article with said first and second apertures aligned;

a retaining nut having a hollow internally threaded body having first and second ends and a first radially outwardly extending flange extending from said first end of said body, said body extending through said first and second apertures of said finishing article with said radial flange seated against said face;

means protruding outwardly from said second end of said body to non-removably secure said retaining nut and said backing member together on said finishing article without the use of adhesives and allowing relative axial movement between said retaining nut and said backing member; and adapter means for applying force to said finishing article when said finishing article is attached to said power tool whereby relative axial movement between said retaining nut and adapter means toward each other is permitted to thereby increasingly compress said finishing article as operative loads are applied to said finishing article during use on said power tool, said adapter means including a spindle carried on said power tool, an inverter generally cup shaped member formed integrally with said spindle, and threads carried by said spindle for engaging said threads on said retaining nut.

* * * * *